US009267246B2

(12) United States Patent
Smieja et al.

(10) Patent No.: US 9,267,246 B2
(45) Date of Patent: Feb. 23, 2016

(54) PAVING MACHINE HAVING VIBRATION-ISOLATED SCREED ASSEMBLY

(71) Applicant: Caterpillar Paving Products Inc., Minneapolis, MN (US)

(72) Inventors: Jameson Michael Smieja, Mound, MN (US); Joseph Arthur Frerich, Champlin, MN (US); Timothy Lee Wehrenberg, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 8 days.

(21) Appl. No.: 14/282,714

(22) Filed: May 20, 2014

(65) Prior Publication Data

US 2015/0337503 A1 Nov. 26, 2015

(51) Int. Cl.

| | |
|---|---|
| ***E01C 19/40*** | (2006.01) |
| ***E01C 19/48*** | (2006.01) |
| ***E01C 19/20*** | (2006.01) |

(52) U.S. Cl.

CPC ..... *E01C 19/40* (2013.01); *E01C 19/20* (2013.01); *E01C 19/48* (2013.01)

(58) Field of Classification Search

CPC ..... E01C 19/48; E01C 19/42; E01C 19/40; E01C 19/20; E01C 23/06

See application file for complete search history.

(56) References Cited

U.S. PATENT DOCUMENTS

| | | | | |
|---|---|---|---|---|
| 3,838,933 | A | 10/1974 | Lehman et al. | |
| 5,009,546 | A * | 4/1991 | Domenighetti et al. | 404/110 |
| 5,046,888 | A * | 9/1991 | King | 404/75 |
| 5,868,522 | A * | 2/1999 | Campbell | 404/114 |
| 7,320,558 | B2 | 1/2008 | Quenzi et al. | |
| 7,540,686 | B2 * | 6/2009 | Heims | 404/102 |
| 8,517,630 | B2 | 8/2013 | Graham et al. | |
| 8,591,142 | B2 * | 11/2013 | Mittleman | 404/98 |
| 2002/0106243 | A1 * | 8/2002 | Rahn et al. | 404/96 |
| 2014/0212217 | A1 * | 7/2014 | Wagner et al. | 404/118 |

FOREIGN PATENT DOCUMENTS

| | | |
|---|---|---|
| CN | 202577116 | 12/2012 |
| EP | 0 586 866 | 1/1998 |
| EP | 1 577 443 | 9/2005 |
| JP | 2009-35900 | 2/2009 |

OTHER PUBLICATIONS

"High Pressure for the Best Roads One Can imagine", pp. 1-4, Apr. 8, 2014.

Brock, J. Don, "Longitudinal Joints: Problem and Solutions", Technical Paper T-130, © Roadtec 2007.

CAT AP1000E AP1055E Pavers, pp. 1-36, © 2011 Caterpillar.

* cited by examiner

*Primary Examiner* — Abigail A Risic

(74) *Attorney, Agent, or Firm* — Finnegan, Henderson, Farabow, Garrett & Dunner, LLP

(57) ABSTRACT

A screed assembly is disclosed for use with a paving machine having a machine frame. The screed assembly may have a main frame operatively connected to the machine frame, and a sub-frame with a body and a screed plate. The screed assembly may also have a vibration isolator disposed between the main frame and the sub-frame, and at least one adjustment mechanism disposed between the body and the screed plate. The at least one adjustment mechanism may be configured to adjust a flatness of the screed plate. The screed assembly may further have a vibration device connected to the body of the sub-frame and configured to vibrate the sub-frame.

18 Claims, 3 Drawing Sheets

PAVING MACHINE HAVING VIBRATION-ISOLATED SCREED ASSEMBLY

TECHNICAL FIELD

The present disclosure relates generally to a paving machine and, more particularly, to a paving machine having a vibration-isolated screed assembly.

BACKGROUND

Paving machines are used to deposit layers of asphalt onto a roadway or parking lot bed. A paving machine generally includes a hopper that receives heated asphalt, a screed, and a conveying system that moves the heated asphalt from the hopper onto the bed in front of the screed. The screed is pushed or pulled over the asphalt to level and shape the asphalt into a layer having a desired thickness and width. In some applications, the paving machine is connected to and towed by a dump truck supplying the asphalt to the hopper. In other applications, the paving machine includes a tractor that self-powers the paving machine.

After the asphalt is deposited in a layer of desired thickness and width onto the roadway or parking lot bed, the asphalt is compacted to increase its density and corresponding durability of the finish layer. In some applications, a vibrating mechanism (e.g., a rotating eccentric weight) is connected to the screed to help prepare the asphalt layer for compacting. In particular, the vibrating screed can help align particles in and pre-compact the asphalt, which may help the ensuing compaction process in some applications.

In conventional paving machine configurations, the screed is rigidly connected to a frame of the paving machine, and the vibrating mechanism vibrates the screed and the machine frame together. This, however, increases the mass that the vibrating mechanism is trying to move. As a result, the vibration amplitude of the screed in conventional configurations may be too small to significantly affect compaction. In addition, vibrating the machine frame may cause premature wear or damage to the machine, and may be uncomfortable for the machine operator.

One attempt to improve the effectiveness of a vibrating screed is disclosed in European Patent No. 586,886 of Ulrich that published on Aug. 5, 1993 ("the '886 patent"). Specifically, the '886 patent discloses an asphalt paver having a chassis, a central drive unit connected to propel the chassis, a hopper mounted to the chassis, and a conveyor device that conveys paving material to a rear of the paver. A screed assembly is attached to the chassis at the rear of the paver, and includes a main screed and extendable auxiliary screeds. Each of the main and auxiliary screeds includes a screed body coupled with the chassis, a screed plate connected to the body, a vibrator connected to the screed plate, and a decoupling device connected between the screed body and the screed plate. The decoupling device can embody a spring or a rubber block, and functions to vibrationally isolate the screed plate from the screed body. This elastic decoupling of the screed plate from the screed body and the remainder of the paver lowers a mass moved by the vibrator and allows for increased vibrational amplitude of the screed plate.

Although the paver of the '886 patent may improve compaction and grain alignment performed by a screed plate, the paver may still be less than optimal. Specifically, it may be important for the screed plate to remain flat throughout operation in order to form a flat surface in the asphalt layer. And connecting the vibrator directly to the screed plate may cause warping, twisting, or other deformation of the screed plate that can negatively affect the asphalt layer. In addition, the '886 patent does not disclose a way to tune a deformed screed plate.

The disclosed paving machine and screed assembly are directed to overcoming one or more of the problems set forth above and/or other problems of the prior art.

SUMMARY

One aspect of the present disclosure is directed to a screed assembly for a paving machine having a machine frame. The screed assembly may include a main frame operatively connectable to the machine frame, and a sub-frame with a body and a screed plate. The screed assembly may also have a vibration isolator disposed between the main frame and the sub-frame, and at least one adjustment mechanism disposed between the body and the screed plate. The at least one adjustment mechanism may be configured to adjust a flatness of the screed plate. The screed assembly may further have a vibration device connected to the body of the sub-frame and configured to vibrate the sub-frame.

Another aspect of the present disclosure is directed to another screed assembly for a paving machine having a machine frame. This screed assembly may include a main frame operatively connectable to the machine frame, and a sub-frame having a body and a screed plate operatively connected to the main frame. The screed assembly may also include first and second vibration devices connected to the body of the sub-frame and aligned end-to-end in a length direction. The first and second vibration devices may be configured to vibrate the sub-frame in phase with each other. The screed assembly may further include a plurality of adjustment mechanisms disposed between the body and the screed plate. Each of the plurality of adjustment mechanisms may be disposed along an edge of the screed plate and configured to adjust a flatness of the screed plate. The screed assembly may additionally include a vibration isolator disposed between the main frame and the sub-frame.

Another aspect of the present disclosure is directed to a paving machine. The paving machine may include a machine frame, a plurality of traction devices configured to support the machine frame, and an engine mounted to the machine frame and configured to drive the plurality of traction devices. The paving machine may also include a hopper mounted at a first end of the machine frame, a conveying system configured to transport material from the hopper to a second end of the machine frame, and a screed assembly mounted at the second end of the machine frame. The screed assembly may have a main screed frame, and a main sub-frame operatively connected to the main screed frame. The main sub-frame may include a body and a screed plate. The screed assembly may also have first and second vibration devices connected to the body of the main sub-frame and aligned end-to-end in a length direction. The first and second vibration devices may be configured to vibrate the main sub-frame in phase with each other. The screed assembly may also have an auxiliary main frame extendably connected at a side of the main screed frame, and an auxiliary sub-frame operatively connected to the auxiliary main frame. The auxiliary sub-frame may include a body and a screed plate. The screed assembly may further have a third vibration device connected to the auxiliary main frame and configured to vibrate the auxiliary sub-frame. The screed assembly may additionally have a plurality of adjustment mechanisms disposed between the main screed frame and the main sub-frame and between the auxiliary main frame and the auxiliary sub-frame. The plurality of adjustment mechanisms may be disposed at edges of the screed plates and configured to adjust a flatness of the screed plates. The screed assembly may also have a plurality of vibration isolators disposed between the main screed frame and the main sub-frame and between the auxiliary main frame and the auxiliary sub-frame.

DETAILED DESCRIPTION

Figure 1:
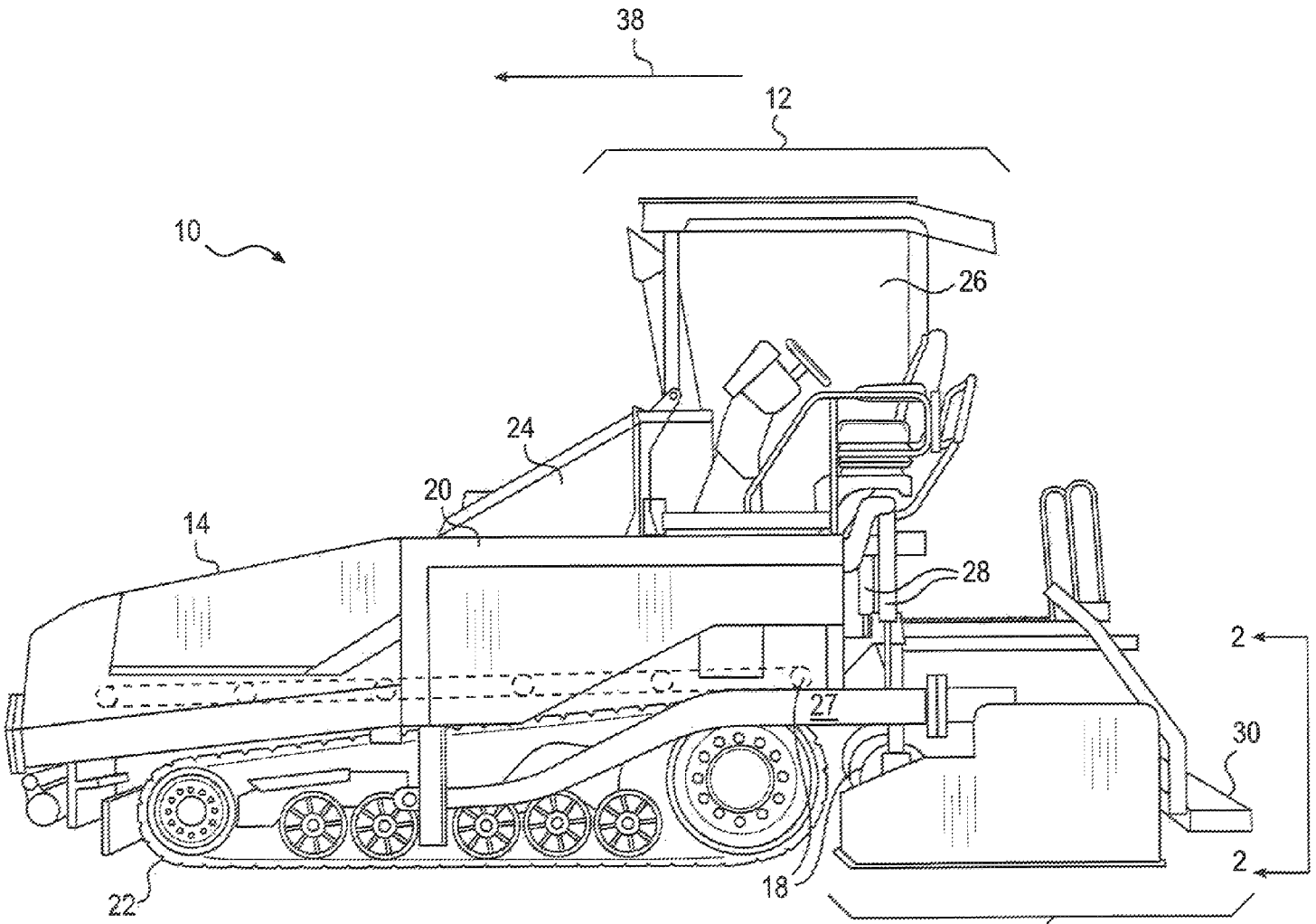
FIG. 1 is a side-view illustration of an exemplary disclosed paving machine.

FIG. 1 illustrates an exemplary paving machine 10 having a tractor portion 12 carrying a front-mounted hopper 14 and towing a screed assembly 16. A conveying system 18 having belts, chains, and/or augers may be situated to transport material (e.g., a hot asphalt mixture) from hopper 14 to screed assembly 16. Screed assembly 16 may then level and shape the material into a layer having a desired thickness and width. In the disclosed example, paving machine 10 is self-powered by way of tractor portion 12. It is contemplated, however, that tractor portion 12 may alternatively be omitted, and hopper 14 and/or screed assembly 16 towed by another machine (e.g., a dump truck), if desired.

Tractor portion 12 may include, among other things, a machine frame 20, a plurality of traction devices 22 (e.g., tracks or wheels—only one shown in FIG. 1) configured to support machine frame 20, a power source (e.g., an engine) 24 configured to drive traction devices 22, and an operator station 26 configured to provide operator control over paving machine 10. Machine frame 20 may support hopper 14, and transmit tractive forces to screed assembly 16 (e.g., by way of tow arms 27—only one shown in FIG. 1). One or more actuators 28 may be connected between machine frame 20 and tow arms 27, and controlled (e.g., for example via operator station 26) to raise, lower, shift, and/or tilt screed assembly 16 relative to machine frame 20. It is also contemplated that screed assembly 16 may generally be free floating, if desired, and only raised or lowered for roading or paving operations, respectively. In the disclosed embodiment, access to operator station 26 may be provided by way of stairs 30 mounted to screed assembly 16.

Figure 2:
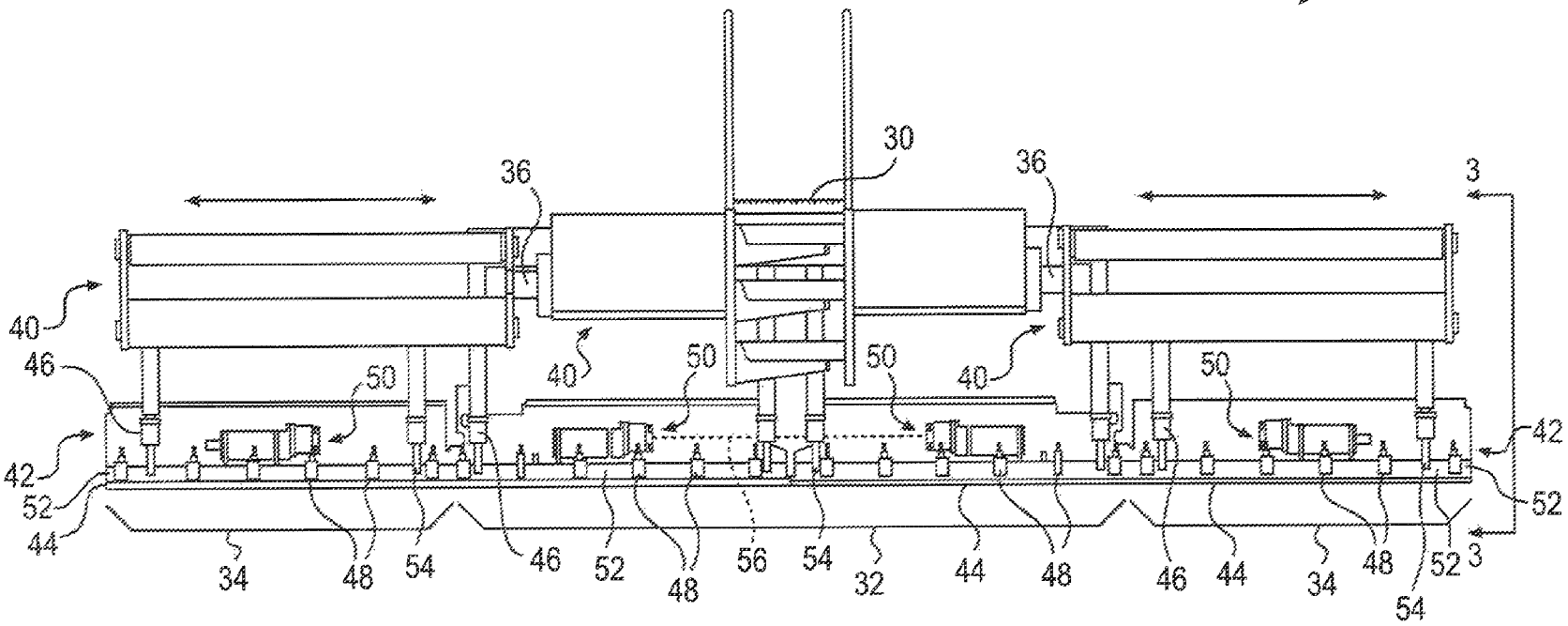
FIG. 2 is an end-view of a screed assembly that may be used in conjunction with the paving machine of FIG. 1.
Figure 3:
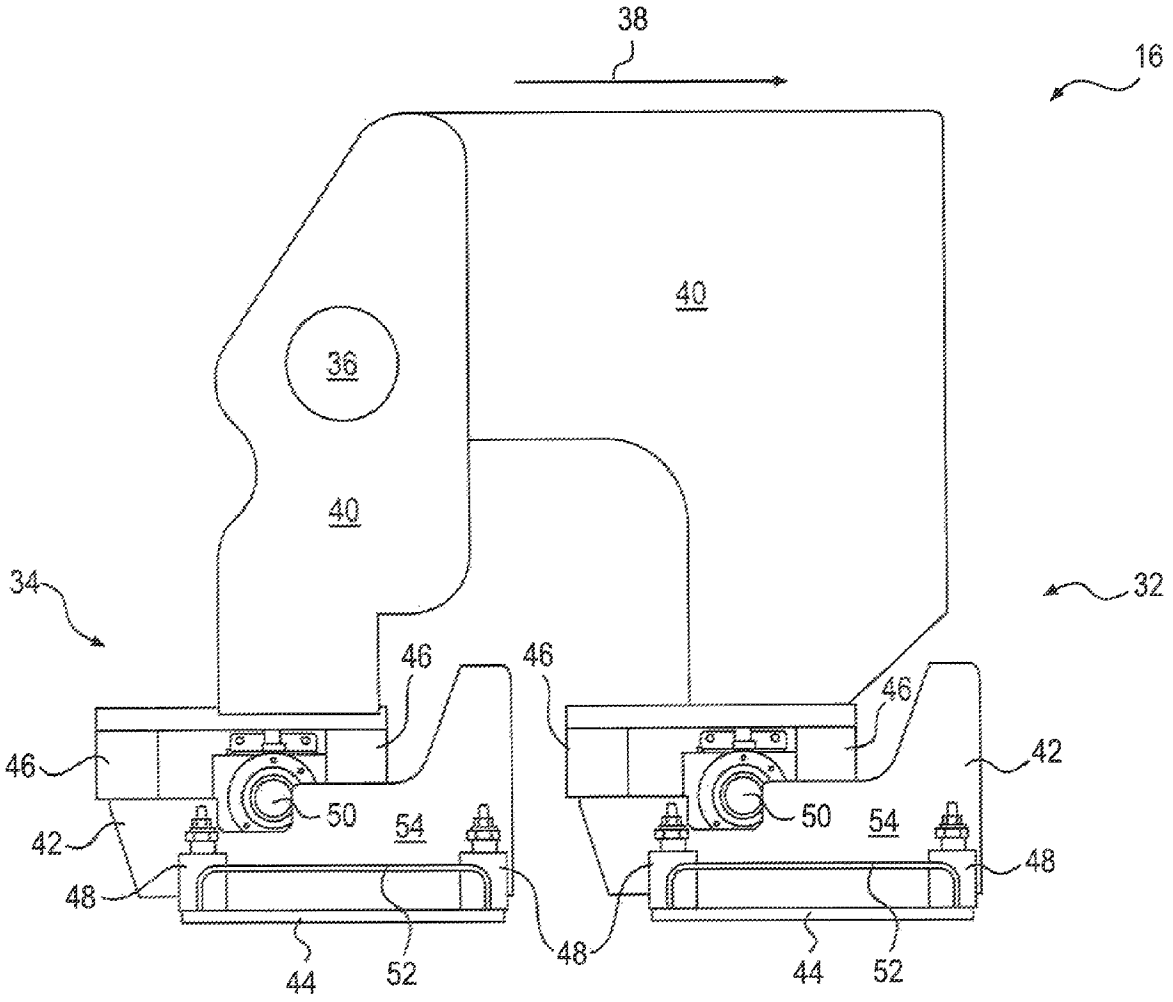
FIG. 3 is a side-view of the screed assembly of FIG. 2.

As shown in FIGS. 2 and 3, screed assembly 16 may be a compilation of components that cooperate to shape, level, and compact the asphalt mixture delivered from hopper 14 onto a road bed in front of screed assembly 16 by conveying system 18. These components may include a main screed 32 and, in some embodiments, one or more auxiliary screeds 34 that are extendably mounted at opposing ends of main screed 32. Auxiliary screeds 34 may be moved in-and-out relative to main screed 32 by way of one or more hydraulic rams 36, so as to adjust a width of the resulting layer of asphalt laid down by screed assembly 16. Auxiliary screeds 34 may be located immediately adjacent main screed 32, in front of main screed 32, or behind main screed 32 (shown in FIG. 3) relative to a normal forward traveling direction of machine 10 represented by an arrow 38 in FIGS. 1 and 3.

Each of main and auxiliary screeds 32, 34 may include a main frame 40 operatively connected to machine frame 20 via two arms 27, a sub-frame 42, and a screed plate 44. Each sub-frame 42 may be connected to its corresponding main frame 40 by way of one or more vibration isolators 46, and each screed plate 44 may be connected to its associated sub-frame 42 via one or more adjustment mechanisms 48. At least one vibration device 50 may be connected to each sub-frame 42. In the disclosed embodiment, two vibration devices 50 are connected to sub-frame 42 of main screed 32, and a single vibration device is connected to sub-frame 42 of each auxiliary screed 34.

Main frame 40 of main screed 32 may be connected directly or indirectly to machine frame 20. For example, main frame 40 may be bolted or welded to tow arms 27, and tow arms 27 may in turn be connected to machine frame 20 by way of actuators 28 (referring to FIG. 1). When tow arms 27 are connected to machine frame 20 via actuators 28, the operator of machine 10 may be able to raise, lower, shift, and/or tilt main frame 40 to adjust a location and/or operation of main screed 32. Main frame 40 of auxiliary screeds 34 may be connected to main frame 40 of main screed 32 and/or to machine frame 20 (e.g., via tow arms 27) via hydraulic rams 36.

Each sub-frame 42 may include, among other things, a body 52 that extends in a length direction of sub-frame 42 (i.e., in a width direction of machine 10), and one or more pedestals 54 that extend in a width direction (i.e., in a depth or fore/aft direction of machine 10). Body 52 may have a general C-shaped cross-section (see FIG. 3) and extend a majority length of the associated screed plate 44 (see FIG. 2). Body 52 may be bent into the C-shape from a flat sheet, and the open side of the C-shape may face screed plate 44. Adjustment mechanisms 48 may be located along lengthwise edges of body 52, and function to connect each body 52 to its corresponding screed plate 44. Any number of adjustment mechanisms 48 may be used for this purpose. Pedestals 54 may rest on the back of the C-shape of sub-frame 42, and function to connect body 52 of sub-frame 42 to main frame 40 via vibration isolators 46. For example, two vibration isolators 46 may be spaced apart in the width direction at opposing ends of each pedestal 54.

Vibration isolators 46 may be configured to vibrationally isolate sub-frame 42 from main frame 40. In the disclosed example, each vibration isolator 46 is a rubber block having a central bore formed therein. A fastener (not shown) may pass through the central bore of the rubber block, and thereby connect sub-frame 42 to main frame 40. In this configuration, vibrations within sub-frame 42 may be at least partially isolated by the elasticity of the rubber blocks and not transmitted into main frame 40. It is contemplated that vibration isolators 46 may take other forms, if desired, such as coil springs, leaf springs, hydraulic dampers, or combinations of rubber blocks, springs, dampers, and/or other components known in the art.

Adjustment mechanisms 48 may take any form known in the art, and be used to adjust a flatness of screed plate 44. In one example, each adjustment mechanism 48 includes a metallic block rigidly connected (e.g., welded) to body 52 of sub-frame 42, and a corresponding fastener rigidly connected to screed plate 44. The fastener may threadingly engage the block, such that as the fastener is rotated, the attached portion of screed plate 44 may be moved closer to or further away from body 52. And by locating adjustment mechanisms 48 at the corners and at spaced-apart positions along the edges of screed plate 44, a flatness of screed plate 44 may be adjusted through cooperating adjustments of individual mechanisms 48. It is contemplated that adjustment mechanisms 48 may have a different configuration, if desired.

Vibration device 50 may be rigidly connected to sub-frame 42 and configured to generate a vibration within screed plate 44. In the disclosed example, vibration device 50 includes a motor connected to rotate an eccentric weight. The motor of vibration device 50 may be bolted directly to body 52 of each sub-frame 42. For example, one motor is shown in FIG. 2 as being bolted to body 52 of each auxiliary screed 34 at a lengthwise intermediate point. In this same example, two motors are shown as being bolted at spaced apart locations to body 52 along a length direction of main screed 34 (e.g., end-to-end at locations that are about equidistant from each other and from ends of body 52). In one example, the motors of vibration devices 50 are hydraulically powered. In this configuration, a pressure and/or a speed of fluid flow through these motors, in connection with a size and eccentricity of the attached weight, may be controlled to affect an amplitude, frequency, and/or phase of the resulting vibration induced within sub-frame 42.

In one embodiment, motor operation of two or more of vibration devices 50 may be synchronized. For example, the rotational phase and frequency of the motors may be synchronized, such that the resulting vibrations do not cancel each other out. This may be of greater importance for the two motors of main screed 32 that are connected to the same sub-frame 42. That is, if the operation of these motors were not synchronized, it might be possible for vibrations induced by one motor to at least partially attenuate vibrations induced by the other motor. It may be less important to synchronize the motors of auxiliary screeds 34, as the vibrations of these motors may be at least somewhat isolated from each other via vibration isolators 46. Accordingly, the motors of auxiliary screed 34 may not be controlled to synchronize their phase and/or frequency with the motors of main screed 32.

Vibrational synchronization may be achieved in any number of different ways. For example, directing parallel flows of pressurized fluid (i.e., rather than serial flows) to the two motors of main screed 34 should result in motor synchronization, as long as the pathways to each motor are substantially identical (e.g., in length and restriction). In another example, the motors may be mechanically constrained (e.g., connected to each other by way of a shaft—represented by a dashed line 56 in FIG. 2) to rotate together. Electronic control over motor operation (e.g., closed loop control that measures and controls speed and/or phase of each motor and/or shaft) may also be possible. It is also contemplated that a combination of hydraulic, mechanical, and electrical control may be used to synchronize the vibrational input to main screed 32 (and/or auxiliary screeds 34, if desired).

INDUSTRIAL APPLICABILITY

The disclosed screed assembly may be applicable to any paving machine. The assembly may allow for a greater amount of high-quality pre-compaction, while also providing for extended screed life. The greater amount of pre-compaction may be provided by way of greater vibrational amplitude imparted to screed plates 44 of the disclosed screed assembly. This greater vibrational amplitude may be the result of the connection of vibration devices 50 to sub-frames 42, and the isolation of sub-frames 42 from main frames 40. In particular, this isolation may reduce the mass that must be moved by the motors of vibration devices 50, allowing for greater movement of screed plates 44. The higher quality compaction may be provided through connection of vibration devices 50 to body 52 (i.e., rather than directly to screed plates 44) and through the use of adjustment mechanisms 48. Specifically, by connecting body 52 to screed plates 44 via adjustment mechanisms 48, the flatness of screed plates 44 may be selectively tuned as screed plates 44 wear and deform. This tuning may result in a greater flatness imparted to the asphalt layer by screed plates 44. And by connecting vibration devices 50 directly to body 52 (i.e., as opposed to screed plates 44), less deformation of screed plates 44 should be caused by vibration devices 50. With less deformation of screed plates 44 and occasional tuning of screed plates 44, the useful life of screed plates 44 should be extended.

It will be apparent to those skilled in the art that various modifications and variations can be made to the disclosed paving machine and screed assembly. Other embodiments will be apparent to those skilled in the art from consideration of the specification and practice of the disclosed paving machine and screed assembly. It is intended that the specification and examples be considered as exemplary only, with a true scope being indicated by the following claims and their equivalents.

What is claimed is:

1. A screed assembly for a paving machine having a machine frame, the screed assembly comprising:

a main frame operatively connectable to the machine frame;

a sub-frame having a body and a screed plate;

a first vibration isolator disposed between the sub-frame and the main frame;

a first adjustment mechanism disposed between the body and the screed plate, the first adjustment mechanism configured to adjust a flatness of the screed plate;

a first vibration device connected to the body of the sub-frame and configured to vibrate the sub-frame;

an auxiliary main frame extendably connected at a side of the main frame;

an auxiliary sub-frame having a body and a screed plate;

a second vibration isolator disposed between the auxiliary sub-frame and the auxiliary main frame, the second vibration isolator configured to substantially isolate the auxiliary sub-frame from the auxiliary main frame and from the main frame of the screed assembly;

a second adjustment mechanism disposed between the body and the screed plate of the auxiliary sub-frame; and a second vibration device connected to the body of the auxiliary sub-frame and configured to vibrate the auxiliary sub-frame.

2. The screed assembly of claim 1, wherein:

the first vibration device and the second vibration device are aligned end-to-end with the first vibration device in a length direction of the sub-frame.

3. The screed assembly of claim 2, wherein each of the first and second vibration devices includes a hydraulic motor connected to rotate an eccentric mass.

4. The screed assembly of claim 3, wherein the hydraulic motor of the first vibration device is controlled to rotate in phase with the hydraulic motor of the second vibration device.

5. The screed assembly of claim 4, wherein the hydraulic motors of the first and second vibration devices are phase aligned via at least one of parallel flows of pressurized fluid, and a mechanical shaft.

6. The screed assembly of claim 2, wherein the first and second vibration devices are phase aligned via closed loop electronic control.

7. The screed assembly of claim 1, wherein the second vibration device operates out of phase with the first vibration device.

8. The screed assembly of claim 1, wherein the first vibration isolator includes a rubber block.

9. The screed assembly of claim 1, wherein the first adjustment mechanism includes a plurality of blocks and bolts threadingly engaged with the plurality of blocks, the plurality of blocks being located along edges of the screed plate and being adjustable to raise or lower the edges.

10. A screed assembly for a paving machine having a machine frame, the screed assembly comprising:

a main frame operatively connectable to the machine frame;

a sub-frame having a body and a screed plate operatively connected to the main frame;

first and second vibration devices connected to the body of the sub-frame and aligned end-to-end in a length direction, the first and second vibration devices configured to vibrate the sub-frame in phase with each other;

a first plurality of adjustment mechanisms disposed between the body and the screed plate, the plurality of adjustment mechanisms disposed along edges of the screed plate and configured to adjust a flatness of the screed plate;

a first vibration isolator disposed between the main frame and the sub-frame an auxiliary main frame extendably connected at a side of the main frame;

an auxiliary sub-frame having a body and a screed plate operatively connected to the auxiliary main frame;

a second plurality of adjustment mechanisms disposed between the body and the screed plate of the auxiliary sub-frame;

a third vibration device connected to the body of the auxiliary sub-frame and configured to vibrate the auxiliary sub-frame; and a second vibration isolator disposed between the auxiliary sub-frame and the auxiliary main frame, the second vibration isolator configured to substantially isolate the auxiliary sub-frame from the auxiliary main frame and from the machine frame.

11. The screed assembly of claim 10, wherein each of the first and second vibration devices includes a hydraulic motor connected to rotate an eccentric mass.

12. The screed assembly of claim 11, wherein the hydraulic motors of the first and second vibration devices are controlled to be phase aligned via parallel flows of fluid.

13. The screed assembly of claim 11, wherein the hydraulic motors of the first and second vibration devices are controlled to be phase aligned via a mechanical shaft.

14. The screed assembly of claim 10, wherein the third vibration device operates out of phase with the first and second vibration devices.

15. The screed assembly of claim 10, wherein the vibration isolator includes a rubber block.

16. The screed assembly of claim 10, wherein the plurality of adjustment mechanisms includes a plurality of blocks and bolts threadingly engaged with the plurality of blocks, the plurality of blocks being located at edges of the screed plate and being adjustable to raise or lower the edges.

17. A paving machine, comprising:

a machine frame;

a plurality of traction devices configured to support the machine frame;

an engine mounted to the machine frame and configured to drive the plurality of traction devices;

a hopper mounted at a first end of the machine frame;

a conveying system configured to transport material from the hopper to a second end of the machine frame; and a screed assembly mounted at the second end of the machine frame, the screed assembly including:

a main screed frame;

a main sub-frame operatively connected to the main screed frame and having a body and a screed plate;

first and second vibration devices connected to the body of the main sub-frame and aligned end-to-end in a length direction, the first and second vibration devices configured to vibrate the main sub-frame in phase with each other;

an auxiliary main frame extendably connected at a side of the main screed frame;

an auxiliary sub-frame operatively connected to the auxiliary main frame and having a body and a screed plate;

a third vibration device connected to the auxiliary sub-frame and configured to vibrate the auxiliary sub-frame;

a plurality of adjustment mechanisms disposed between the main screed frame and the main sub-frame and between the auxiliary main frame and the auxiliary sub-frame, the plurality of adjustment mechanisms disposed along edges of the screed plates and configured to adjust a flatness of the screed plates; and a plurality of vibration isolators disposed between the main screed frame and the main sub-frame and between the auxiliary main frame and the auxiliary sub-frame.

18. The paving machine of claim 17, wherein the third vibration device operates out of phase with the first and second vibration devices.

* * * * *